US006112632A

United States Patent [19]

Buchholtz et al.

[11] Patent Number: 6,112,632

[45] Date of Patent: Sep. 5, 2000

[54] CUTTING MEMBER FOR THE SAW CHAIN OF A MOTOR CHAINSAW

[75] Inventors: Jochen Buchholtz, Waiblingen; Christoph Cramer, Stuttgart, both of Germany

[73] Assignee: Andreas Stihl AG & Co., Germany

[21] Appl. No.: 09/070,860

[22] Filed: Apr. 30, 1998

[30] Foreign Application Priority Data

Apr. 30, 1997 [DE] Germany ..... 197 18 268

[51] Int. Cl.[7] ..... B27B 33/14

[52] U.S. Cl. ..... 83/830; 834/846

[58] Field of Search ..... 83/830, 835, 852, 83/837, 834, 846, 850–854, 831–833

[56] References Cited

U.S. PATENT DOCUMENTS

| | | | |
|---|---|---|---|
| 2,947,331 | 8/1960 | Irgens . | |
| 4,604,932 | 8/1986 | Doiron | 83/830 |
| 4,785,700 | 11/1988 | Petrovich et al. | 83/830 |
| 4,841,824 | 6/1989 | Hartmann et al. | 83/830 |
| 4,850,407 | 7/1989 | Inkster et al. | 83/835 |
| 4,873,903 | 10/1989 | Harfst | 83/830 |
| 4,911,050 | 3/1990 | Nitschmann . | |
| 5,042,350 | 8/1991 | Nitschmann | 83/830 |
| 5,065,658 | 11/1991 | Ziegelmeyer | 83/830 |
| 5,090,287 | 2/1992 | Chezem | 83/835 |
| 5,257,568 | 11/1993 | Nitschmann | 83/830 |
| 5,666,871 | 9/1997 | Burrows et al. | 83/830 |
| 5,740,715 | 4/1998 | Burrows et al. | 83/830 |

FOREIGN PATENT DOCUMENTS

| | | |
|---|---|---|
| 0712700 | 5/1996 | European Pat. Off. . |
| 20418 | 1/1959 | Germany . |

*Primary Examiner*—M. Rachuba
*Attorney, Agent, or Firm*—Robert W. Becker & Associates

[57] ABSTRACT

The cutting member for a saw chain of a motor chainsaw has a base body with a rear portion and a leading portion in a cutting direction of the cutting member. The rear portion and the leading portion extend in the center plane. The base body has rivet openings. The cutting tooth is formed at the rear portion and the depth limiter is formed at the leading portion. The leading portion has a support stay formed by bending at a bending line an upper end portion of the leading portion in a direction out of the center plane. The free end of the upper end portion is bent in a second direction opposite the first direction back across the base body to form an overhang. The overhang has a forwardly and downwardly slanted surface facing away from the base body. The overhang has a length in the cutting direction that is smaller than the width of the support stay. The support stay has a stay edge facing the cutting tooth. The overhang edge has a greater spacing to the cutting tooth than the stay edge. The stay edge positioned higher than the overhang edge.

13 Claims, 2 Drawing Sheets

Fig. 1
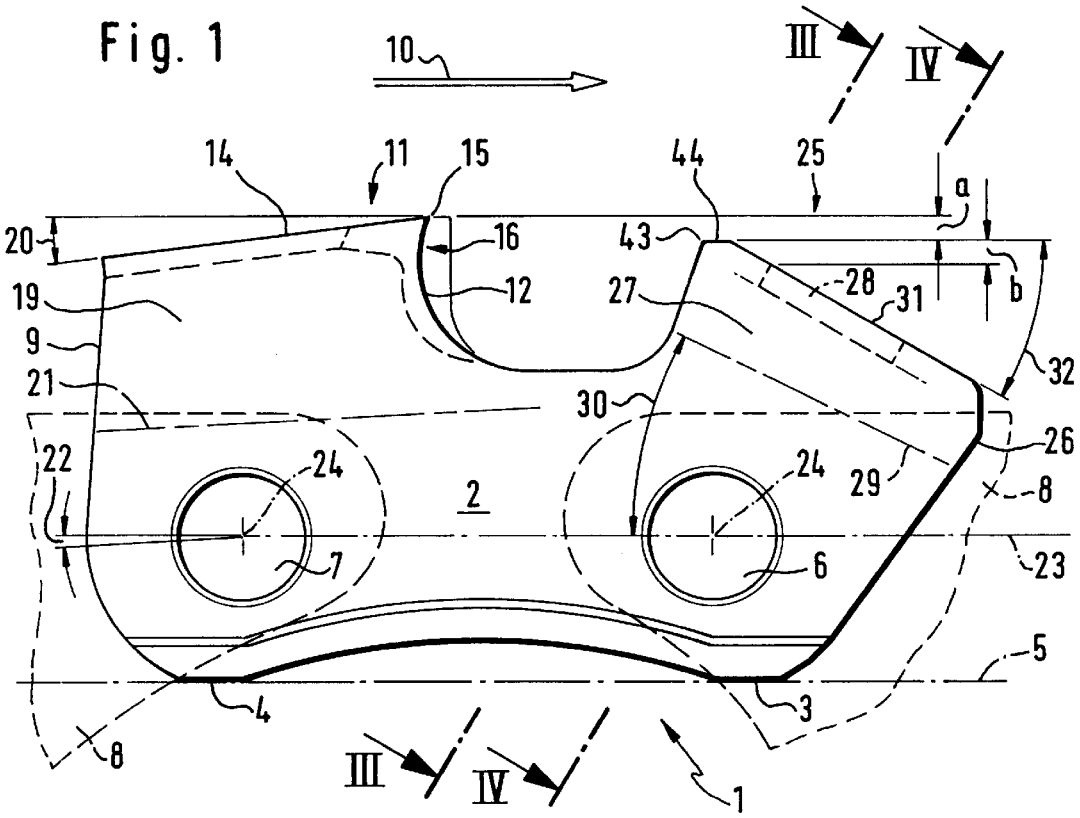
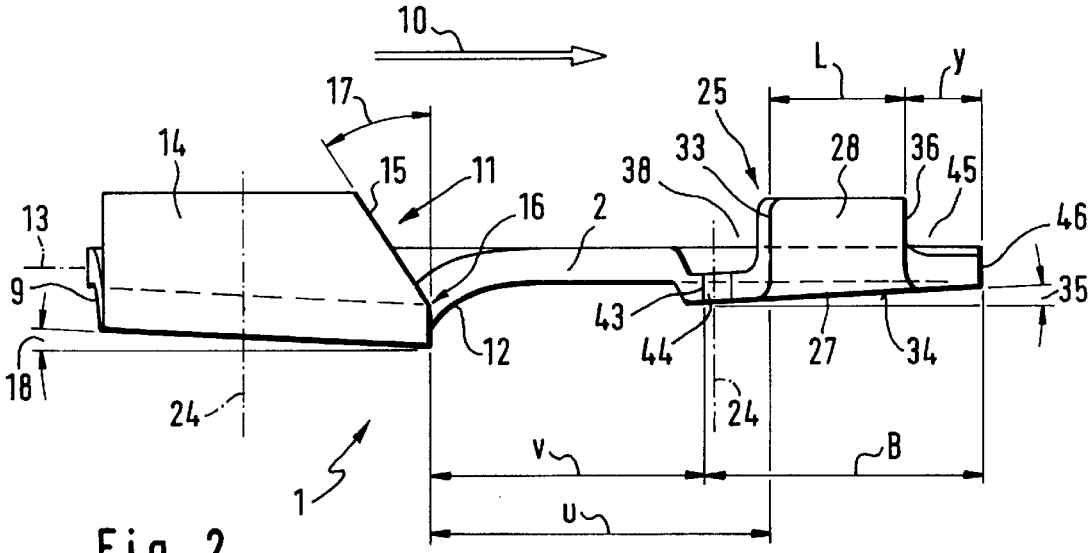
Fig. 2

CUTTING MEMBER FOR THE SAW CHAIN OF A MOTOR CHAINSAW

BACKGROUND OF THE INVENTION

The present invention relates to a cutting member for the saw chain of the motor chainsaw. The cutting member is comprised of a base body having rivet openings for connecting the cutting member to neighboring chain members. The base body comprises a cutting tooth which is positioned at the rear portion of the base body when viewed in the cutting direction of the cutting member. A depth limiter is positioned in front of the cutting tooth and is formed at the leading portion of the base body. The leading portion has a support stay that is formed by bending the upper end portion of the leading portion in a first direction relative to the center plane. The free end of the upper end portion is then bent in a second direction opposite the first direction across the base body to form an overhang. The overhang forms a forwardly downwardly, slanted surface.

From U.S. Pat. No. 4,911,050 such a cutting member is known. Its base body is connected by rivet connections to the neighboring chain members. At the rear portion of the base body a cutting tooth is provided whereby the rear portion is bent out of the center plane of the base body for forming a lateral cutting blade and the free end of the lateral cutting blade is bent across the base body in order to form an overhang blade. The cutting tooth is provided with a depth limiter positioned in front thereof in the cutting direction. This depth limiter is provided at the leading portion of the base body whereby the leading portion is bent in a first direction out of the plane of the base body for forming the support stay and the free end is then bent in the opposite direction across the base body for forming an overhang. The overhang is provided with a forwardly and downwardly slanted surface facing away from the base body.

Such cutting members have very high cutting output with low drive power. They are stamped and then formed whereby the bending of the free end at the leading portion of the base body for forming the overhang at the depth limiter is difficult. It has been shown that despite precise bending processes due to the unavoidable elastic action a precise positioning of the overhang edge of the depth limiter facing the cutting tooth is adjustable only within certain tolerance ranges. However, especially the spacing of the overhang edge relative to the cutting edge of the cutting blade at the rear portion is of very great importance for the cutting action and cutting performance. When the spacing is too great, the cutting member will get caught and there is the risk of a kickback effect.

When the spacing is too small, the cutting efficiency of the cutting member is considerably reduced. The tolerance range that must be observed is a compromise between a satisfactory cutting output and high safety against catching and thus against the kickback effect.

It is therefore an object of the present invention to embody a cutting member of the aforementioned kind such that with simple constructive means the spacing of the depth limiter to the cutting blade at the rear portion can be maintained within narrow tolerance ranges.

SUMMARY OF THE INVENTION

The inventive cutting member for a saw chain of a motor chainsaw is primarily characterized by:

A base body comprised of a rear portion and a leading portion in a running direction of the cutting member, wherein the rear portion and the leading portion extend in the center plane;

The base body having rivet openings;

A cutting tooth formed at the rear portion;

A depth limiter formed at the leading portion;

The leading portion having a support stay formed by bending at a bending line an upper end portion of the leading portion in a first direction out of the center plane;

Wherein the free end of the upper end portion is bent in a second direction opposite the first direction back across the base body to form an overhang;

The overhang having a forwardly and downwardly slanted surface facing away from the base bodies;

The overhang having a length in the running direction that is smaller than the width of the support stay;

The overhang having an overhang edge extending transverse to the running direction and facing the cutting tooth;

The support stay having a stay edge facing the cutting tooth;

The overhang edge having a greater spacing to the cutting tooth than the stay edge;

The stay edge positioned higher than the overhang edge.

Advantageously, the support stay has a flattened portion adjacent to the stay edge.

The flattened portion is preferably parallel to the plane in which the center axes of the rivet openings are positioned.

Advantageously, the flattened portion extends at a right angle to the center plane.

Preferably, the cutting tooth has a cutting blade with a forward cutting edge, wherein the stay edge is positioned at a vertical distance below the highest point of the cutting edge.

Expediently, the stay edge is based at a vertical spacing below the overhang edge and the vertical spacing is substantially identical to the vertical distance.

Preferably, the stay edges are positioned closer to the cutting tooth than the center axis of the rivet opening in the leading portion.

The support stay has an outer surface that projects past the lateral surface of the base body by a predetermined amount.

Advantageously, the support stay extends at a slant in the running direction such that the forward end of the support stay is closer to the center plane than a rearward end of the support stay.

The bending line extends at an angle of approximately 26° to a plane in which the center axes of the rivet openings are positioned.

Preferably, the overhang extends at a right angle to the center plane.

During manufacturing of the cutting member the overhang is shortened relative to the support stay.

Preferably, the overhang in the running direction is downwardly slanted at an angle of approximately 30° relative to the plane in which the center axes of the rivet openings are positioned.

The inner contour of the depth limiter is preferably rounded.

The inventive construction is such that the stay edge of the support stay facing the cutting tooth acts first as a depth limiter, whereby the stay edge is higher than the overhang edge of the overhang which is positioned such that, in the cutting direction, it is arranged upstream of the stay edge and faces the cutting tooth. This means that first only the stay edge of the depth limiter limits the engagement of the cutting tooth in the wood to be cut, i.e., the depth limiter has only a small or minimal contact surface in the cutting groove. This reduces the required drive power of the inventive cutting member. For an unchanged drive power the cutting efficiency of the inventive cutting member is substantially increased. The spacing of the stay edge of the support stay to the overhang edge can be maintained in a constructively simple manner and within narrow tolerances because the stay edge is not provided at the free end of the leading portion that is bent in the second direction across the base body. The stay edge of the relatively stiff support stay does not exhibit spring elastic behavior during machining so that a precise manufacture is possible. A saw chain that is embodied with the inventive cutting members thus exhibits a strong, uniform, and slip-resistant cut.

Preferably, the cutout portions at the overhang of the depth limiter are manufactured during stamping of the cutting member so that the cutting member itself can be produced without expensive manufacturing measures as a simple mass-produced part.

BRIEF DESCRIPTION OF THE DRAWINGS

The object and advantages of the present invention will be explained in the following with the aid of the accompanying drawings, in which:

FIG. 1 shows a side view of the inventive cutting member in an enlarged representation;

FIG. 2 shows a plan view of the cutting member according to FIG. 1;

DESCRIPTION OF PREFERRED EMBODIMENTS

Figure 3:
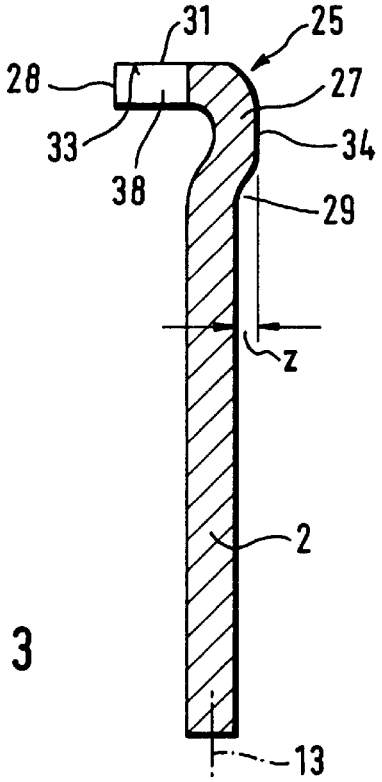
FIG. 3 shows a section along the line III—III of FIG. 1.

The cutting member 1 shown in the embodiment of FIGS. 1–4 is a lateral member of a saw chain for a motor chainsaw. It is comprised of a base body 2 which at its bottom area has a leading running surface 3 and a rear running surface 4 in the running direction 10. The running surfaces are positioned on a guide track 5 which is formed to the right and to the left of the guide groove at the outer circumference of a guide bar.

The base body 2 has a leading rivet opening 6 in the running direction as well as a rear rivet opening 7 in which connecting rivets for connecting the cutting member 1 to neighboring, schematically represented chain members 8 are provided.

Viewed in the running direction 10 an upright rear portion 9 with a cutting tooth 11 is provided to the rear of the base body. The rear portion 9 is, as can be seen especially in FIG. 2, bent out of the plane 13 of the base body 2 for forming a lateral cutting blade 12 whereby the free end of the rear portion 9 is bent in the opposite direction across the base body for forming an overhang cutting blade 14. The leading edge 15 of the overhang cutting blade 14 thus forms a breast cutting edge which, together with the lateral cutting edge 12 and the forward cutting edge 16, defines the cutting tooth in the running direction of the saw chain. The leading edge 15 of the overhang cutting blade 14 is positioned at an angle 17 of preferably 30° transverse to the running direction 10 whereby the free inner edge of the cutting edge 15 in the running direction 10 follows the lateral cutting edge 12. As is shown in FIG. 2, the stay 19 of the lateral cutting edge 12 is positioned at an angle 18 of approximately 3° relative to the running direction 10. The angle opens counter to the running direction.

The overhang cutting blade 14 is slanted against the running direction 10 at an angle 20 of preferably approximately 7°. The bending edge 21 at the bottom of the stay 19 is positioned at an angle 22 of approximately 3° to the plane 23 in which the center axes 24 of the rivet openings 6, 7 are positioned. The cutting edge 16 is positioned, when viewed in the plan view of FIG. 2, between the center axes 24 of the rivet openings 6, 7.

The cutting tooth 11 has positioned in front of it a depth limiter 25. It is formed at a leading portion 26 of the base body 2 in the running direction 10 positioned upstream of the rear portion 9. The leading portion 26 is bent for forming a support stay 27 out of the plane 13 of the base body 1 and the free end of the bent portion is bent in the opposite direction for forming the overhang 28 at the base body 2.

The bending line 29 at the lower portion of the support stay 27 is positioned at an angle 30 relative to the plane 23 defined by the center axes 24 of the rivet openings 6, 7. The angle 30 is preferably approximately 26°.

The overhang 28 is forwardly and downwardly slanted in the running direction 10 whereby the overhang surface 31, downwardly pointing in the running direction 10, is positioned at an angle 32 of approximately 30° to the plane 23 of the center axes 24 of the rivet openings 6 and 7. The slanted surface 31 thus has at a greater slant than the bending line 29.

As can be seen in the plan view of FIG. 2, the overhang 28 has a length L in the running direction 10 that is smaller than the width B of the support stay 27 measured in the running direction 10. The overhang surface 31 is substantially positioned at a right angle to the plane 13 of the base body 2 whereby the overhang edge 33 facing the cutting tooth 11 has a greater spacing u than the stay edge 43 of the support stay 27 facing the cutting tooth whereby the stay 27 at least within the connecting area to the overhang 28 is wider. From FIG. 1 it can be taken that the stay edge 43 relative to the plane 23 of the center axes 24 of the rivet openings 6, 7 has a predetermined spacing a to the cutting edge 15 of the overhang cutting blade 14. The stay edge 43 is furthermore higher, relative to the plane 23, by spacing b higher than the overhang edge 33 of the overhang 28 of the depth limiter 25. Expediently, the spacing b of the stay edge 43 to the overhang edge 33 is approximately as great as the spacing a of the stay edge 43 to the cutting edge 15 of the overhang cutting blade 14. In a plan view the stay edge 43 is positioned closer to the cutting edge 16 than the center axis 24 of the leading rivet opening 6.

Preferably, the stay edge 43 has adjacent thereto a flattened portion 44 which extends substantially parallel to the plane 23 that is defined by the center axes 24 of the openings 6,7. Accordingly, the flattened portion 44 is positioned at a right angle to the plane 13 of the base body 1.

Figure 4:
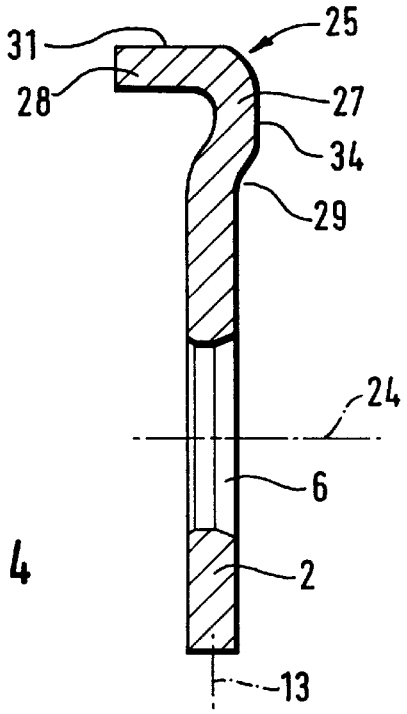
FIG. 4 shows a section along the line IV—IV of FIG. 1.

As can be seen in FIGS. 2–4, the support stay 27 is displaced relative to the plane 13 of the base body 1 by a predetermined amount z parallel outwardly. Its outer side 34 is positioned at an angle 35 of approximately 30 relative to the running direction 10. The angle 35 opens in the running direction. At the inner side the inner contour of the depth limiter 25 is rounded.

As can be seen in FIG. 2, the depth limiter 25 is more narrow than the cutting tooth 11 so that the longitudinal edges of the overhang 28 extending in the running direction 10 are positioned at a lateral spacing to the longitudinal edges of the cutting tooth 11, similar to the longitudinal edges of the support stay 27.

On the side facing the cutting tooth 11, the leading edge 46 of the support stay 27 in the running direction 10 is displaced by an amount y to the overhang edge 36 of the overhang 28 transverse to the running direction 10. The overhang edges 36 and 33 extending transverse to the running direction 10 are thus positioned at a spacing to the respective stay edges 43 and 46 of the support stay 27 of the depth limiter 25.

While the leading cutout 45 provides a free space at the depth limiter 25 for uninterrupted relative movement between the cutting members and the connecting members 8, the cutout 38 at the cutting tooth 11 provides for a certain behavior of the depth limiter. During cutting, the depth limiter is first supported by the stay edge 43, respectively, the flattened portion 44 at the bottom of the cutting groove without the overhang 28 resting at the cutting groove. Accordingly, the cutting resistance of the inventive cutting member is minimal. The drive power can be reduced, whereby, for the same amount of motor output, an increase of the cutting output can be achieved. The spacing a to the edge 15 of the overhang cutting blade 14, necessary for a proper function of the saw chain, is realized by embodying the stay edge 43 within narrow tolerances. This allows for a more uniform, more quiet cutting action of a chainsaw provided with the inventive cutting members.

The specification incorporates by reference the disclosure of German priority document 197 18 268.2 of Apr. 30, 1997.

The present invention is, of course, in no way restricted to the specific disclosure of the specification and drawings, but also encompasses any modifications within the scope of the appended claims.

What is claimed is:

1. A cutting member for a saw chain of a motor chainsaw, comprising:

a base body comprised of a rear portion and a leading portion in a running direction of said cutting member, wherein said rear portion and said leading portion extend in said center plane;

said base body having rivet openings;

a cutting tooth formed at said rear portion;

a depth limiter formed at said leading portion;

said leading portion having a support stay formed by bending at a bending line an upper end portion of said leading portion in a first direction out of said center plane;

wherein a free end of said upper end portion is bent at a bending location in a second direction opposite said first direction back across said base body to form an overhang;

said overhang having a forwardly and downwardly slanted surface facing away from said base body;

said support stay having a stay edge facing said cutting tooth;

said overhang having a cutout cut away in said running direction and away from said stay edge so that said overhang has a length at said bending location in said running direction that is smaller than a width of said support stay;

said overhang having an overhang edge at said cutout extending transverse to said running direction and facing said cutting tooth;

said overhang edge having a greater spacing u to said cutting tooth than said stay edge;

said stay edge positioned higher than said overhang edge.

2. A cutting member according to claim 1, wherein said support stay has a flattened portion adjacent to said stay edge.

3. A cutting member according to claim 2, wherein said flattened portion is parallel to a plane in which center axes of said rivet openings are positioned.

4. A cutting member according to claim 3, wherein said flattened portion extends at a right angle to said center plane.

5. A cutting member according to claim 1, wherein said cutting tooth has a cutting blade with a forward cutting edge, wherein said stay edge is positioned at a vertical distance a below a highest point of said cutting edge.

6. A cutting member according to claim 5, wherein said stay edge is spaced at a vertical spacing b to said overhang edge and wherein said vertical spacing is identical to said vertical distance a.

7. A cutting member according to claim 1, wherein said stay edge is positioned closer to said cutting tooth than the center axis of said rivet opening in said leading portion.

8. A cutting member according to claim 1, wherein said support stay has an outer surface that projects past a lateral surface of said base body by a predetermined amount.

9. A cutting member according to claim 1, wherein said support stay extends at a slant in said running direction such that a forward end of said support stay is closer to said center plane than a rearward end of said support stay.

10. A cutting member according to claim 1, wherein said bending line extends at an angle of approximately 26° to a plane in which center axes of said rivet openings are positioned.

11. A cutting member according to claim 1, wherein said overhang extends at a right angle to said center plane.

12. A cutting member according to claim 1, wherein said overhang in said running direction is downwardly slanted at an angle of approximately 30° relative to a plane in which center axes of said rivet openings are positioned.

13. A cutting member according to claim 1, wherein an inner contour of said depth limiter is rounded.

* * * * *